US007000824B2

(12) United States Patent
Saulas

(10) Patent No.: US 7,000,824 B2
(45) Date of Patent: Feb. 21, 2006

(54) CARTON AND CARTON BLANK THEREFOR

(75) Inventor: Alain Saulas, Chateauroux (FR)

(73) Assignee: MeadWestvaco Packaging Systems, LLC, Stamford, CT (US)

( * ) Notice: Subject to any disclaimer, the term of this patent is extended or adjusted under 35 U.S.C. 154(b) by 94 days.

(21) Appl. No.: 10/389,429

(22) Filed: Mar. 14, 2003

(65) Prior Publication Data

US 2004/0007614 A1 Jan. 15, 2004

Related U.S. Application Data

(63) Continuation of application No. PCT/US01/28504, filed on Sep. 15, 2001.

(51) Int. Cl.
*B65D 17/00* (2006.01)

(52) U.S. Cl. ..... 229/243; 229/191; 229/168; 229/244; 229/926; 229/210

(58) Field of Classification Search ..... 229/191, 229/243, 242, 244, 168, 207, 924, 925, 926, 229/210
See application file for complete search history.

(56) References Cited

U.S. PATENT DOCUMENTS

| | | | | | |
|---|---|---|---|---|---|
| 1,653,116 | A | | 12/1927 | Parks | |
| 1,717,367 | A | * | 6/1929 | Byrne | 229/233 |
| 2,398,404 | A | * | 4/1946 | Brooks | 229/125.35 |
| 2,555,581 | A | * | 6/1951 | Dunning | 229/135 |
| 2,758,775 | A | * | 8/1956 | Moore | 229/122.23 |
| 2,885,137 | A | | 5/1959 | Guyer | |
| 3,184,136 | A | | 5/1965 | Forbes, Jr. | |
| 3,580,482 | A | * | 5/1971 | Witte | 229/229 |
| 3,905,646 | A | | 9/1975 | Brackmann et al. | |
| 3,910,487 | A | | 10/1975 | Jaeshke | |
| 4,056,223 | A | * | 11/1977 | Williams | 229/160 |
| 4,236,662 | A | | 12/1980 | Roccaforte | |
| 4,319,710 | A | | 3/1982 | Osborne | |
| 4,340,170 | A | | 7/1982 | Montealegre | |
| 4,417,661 | A | * | 11/1983 | Roccaforte | 229/232 |
| 4,805,375 | A | | 2/1989 | Langen et al. | |
| 5,100,004 | A | * | 3/1992 | Kuchenbecker | 229/238 |
| 5,197,598 | A | | 3/1993 | Stout et al. | |
| 5,385,234 | A | * | 1/1995 | Stout et al. | 206/427 |
| 5,452,848 | A | | 9/1995 | Mur Gimeno | |
| 5,588,585 | A | * | 12/1996 | McClure | 229/191 |
| 5,673,848 | A | | 10/1997 | Garza | |
| 5,992,735 | A | * | 11/1999 | Oosterbaan | 229/191 |

FOREIGN PATENT DOCUMENTS

| | | | |
|---|---|---|---|
| DE | 2 124 285 | A | 12/1971 |
| EP | 1 033 312 | A1 | 9/2000 |
| FR | 1 501 894 | | 9/1966 |
| FR | 2 458 469 | A | 1/1981 |
| FR | 2 731 382 | A1 | 9/1996 |
| GB | 1 206 773 | | 9/1970 |
| GB | 2 137 168 | A | 10/1984 |
| GB | 2 196 608 | A | 5/1988 |
| JP | 11-105855 | A | 11/1999 |
| JP | 2001-219927 | * | 8/2001 |
| WO | 98/18682 | | 7/1998 |
| WO | 00/23334 | | 4/2000 |

* cited by examiner

*Primary Examiner*—Tri M. Mai
(74) *Attorney, Agent, or Firm*—Tsugihiko Suzuki

(57) ABSTRACT

A carton and a blank for forming a carton for holding a plurality of articles, for example bottles, comprising a collapsible tubular corner post formed from an extension of a carton side wall. The corner post is adapted to move from a flat collapsed condition when extending outwardly of the carton to be automatically erected by folding the corner post inwardly.

13 Claims, 7 Drawing Sheets

CARTON AND CARTON BLANK THEREFOR

This is a continuation of international application No. PCT/US01/28504, filed Sep. 15, 2001, which is hereby incorporated by reference.

BACKGROUND OF THE INVENTION

The invention relates to a carton and to a blank for forming a carton for carrying a plurality of articles, for example flexible pouches or bottles, and one or more beam structures for improving the rigidity of the carton. It may further comprise a tear-open flap that can be reclosed.

The use of beam structures is known; for example, in U.S. Pat. No. 5,673,840 there is shown a corner post structure for improving the rigidity of the carton. The invention is particularly useful where it is desirable for cartons containing articles to be enclosed to protect each article, for example information discs or foodstuffs.

One example of reclosable sleeves formed from one or more blanks of cardboard is found in U.S. Pat. No. 3,078,030 which illustrates a carton having an integral hinged top that it reclosable. The top is provided by a front cover panel and a spacer panel secured to one side of the front cover panel to interfit with a mating upper portion of the front panel of a box. Fastening means is formed from a detached double layer portion of the front panel. However, the detached portion is attached to the inside surface of the cover flap, resulting in a stepped non-flat front surface.

In U.S. Pat. No. 3,894,680 there is provided a dispensing spout in a carton box adapted to accommodate powdery materials, for example detergents, which spout is adapted to keep closed after it has been cut out. The fastening means is formed from a detached triple layer portion of the front panel but it does not define a pocket to retain the spout.

Further, supporting the weak parts of a carton, such as corners and the like, is well known. For example, U.S. Pat. No. 5,673,840 illustrates a corner post structure. However, in automated packaging, it is necessary to load articles into the carton at high speeds; therefore, it is undesirable to have a complicated arrangement for forming a corner post structure.

SUMMARY OF THE INVENTION

The present invention seeks to overcome or at least mitigate the problems of the prior art.

One aspect of the invention provides a carton for holding a plurality of articles, for example bottles, comprising a collapsible tubular corner post formed from an extension of a carton side wall, which corner post is adapted to move from a flap collapsed condition when extending outwardly of the carton to be automatically erected by folding the corner post inwardly.

One advantage of this arrangement is that the blank and corner post can be supplied to the end user in a flat collapsed condition. It can then be automatically deployed by automatic packaging machinery by a simple folding process. Beneficially, the amount of board for the corner post can be reduced and standard equipment to secure the end panels can be used.

Preferably, the corner post may have a triangular cross-section to serve as a rigid structure wherein the corner post has a longitudinally extending fold line to allow the corner post to be folded flat only outwardly of the carton. More preferably, the corner post may comprise an end panel, a bracing panel and a securing panel hingedly connected together in series, and the securing panel is secured to the carton side wall. Optionally, the longitudinally extending fold line may be formed in the end panel.

According to an optional feature of this aspect of the invention the end panel may be adapted to secure an end flap of the carton to close the carton.

A second aspect of the invention provides a carton for holding a plurality of articles, for example bottles, which carton comprises a reclosable tear open flap formed from a first carton wall and a wall end-reinforcing member hinged to the first carton wall. The reinforcing member is affixed at least in part to the inside surface of the first carton wall so that the reinforcing member underlies the first carton wall along at least a part of the tear line. Optionally the reinforcing member extends above the tear line to provide upon breaking of the tear line an engaging element for retaining the flap in a reclosed position.

A third aspect of the invention provides a carton for holding a plurality of articles, for example bottles, which carton comprises a reclosable tear open flap including a first panel formed from a first carton wall and an engaging panel affixed at least in part to the inside surface of the first carton wall. The engaging panel extends above the tear line to provide upon breaking of the tear line an engaging element for retaining the flap in a reclosed position.

According to an optional feature of the third aspect of the invention, the engaging panel is provided by a reinforcing member hinged to one of the panels adjacent the first carton wall panel. Preferably, the reinforcing member underlies the first carton wall at the corner with a second carton wall, thereby to reinforce the corner.

According to another optional feature of the second or third aspect of the invention, the tear open flap comprises a second panel hingedly connected to the first panel.

Preferably, the tear open flap further comprises a pull tab.

More preferably, the first carton wall is provided with a securing tab hingedly connected thereto, and a portion of the tear open flap or, as the case may be, the pull tab, is adapted to be placed intermediate the first carton wall and the securing tab to be retained therewith.

A fourth aspect of the invention provides a blank for forming a carton for holding a plurality of articles, for example bottles, which carton comprises a reclosable tear open flap formed from a first carton wall and a wall end-reinforcing member hinged to the first carton wall, wherein the reinforcing member is affixed at least in part to the inside surface of the first carton wall so that the reinforcing member underlies the first carton wall along at least a part of the tear line.

Preferably, the corner post may have a longitudinally extending fold line to allow the corner post to be folded flat only outwardly of the carton. More preferably, the longitudinally extending fold line may be formed in the end panel.

A fifth aspect of the invention provides a blank for forming a carton for holding a plurality of articles, for example bottles, comprising a collapsible tubular corner post formed from an extension of a carton side wall, wherein the corner post comprises an end panel, a bracing panel and a securing panel hingedly connected together in series, wherein said securing panel is adapted to be secured to said carton side wall.

Optionally, the corner post has a longitudinally extending fold line to allow the corner post to be folded flat only outwardly of the carton. Preferably, the longitudinally extending fold line is formed in said end panel.

A sixth aspect of the invention provides a blank for forming a carton for holding a plurality of articles, for example bottles, which carton comprises a reclosable tear open flap including a first panel formed from a first carton wall and an engaging panel affixed at least in part to the inside surface of the first carton wall wherein the reinforcing member extends above the tear line to provide upon breaking of the tear line an engaging element for retaining the flap in a reclosed position, when the carton is in a set up condition. Optionally, the tear open flap further comprises a pull tab.

BRIEF DESCRIPTION OF THE DRAWINGS

Exemplary embodiments of the invention will now be described, by way of example only, with reference to the accompanying drawings in which.

DETAILED DESCRIPTION OF THE PREFERRED EMBODIMENTS

Figure 1:
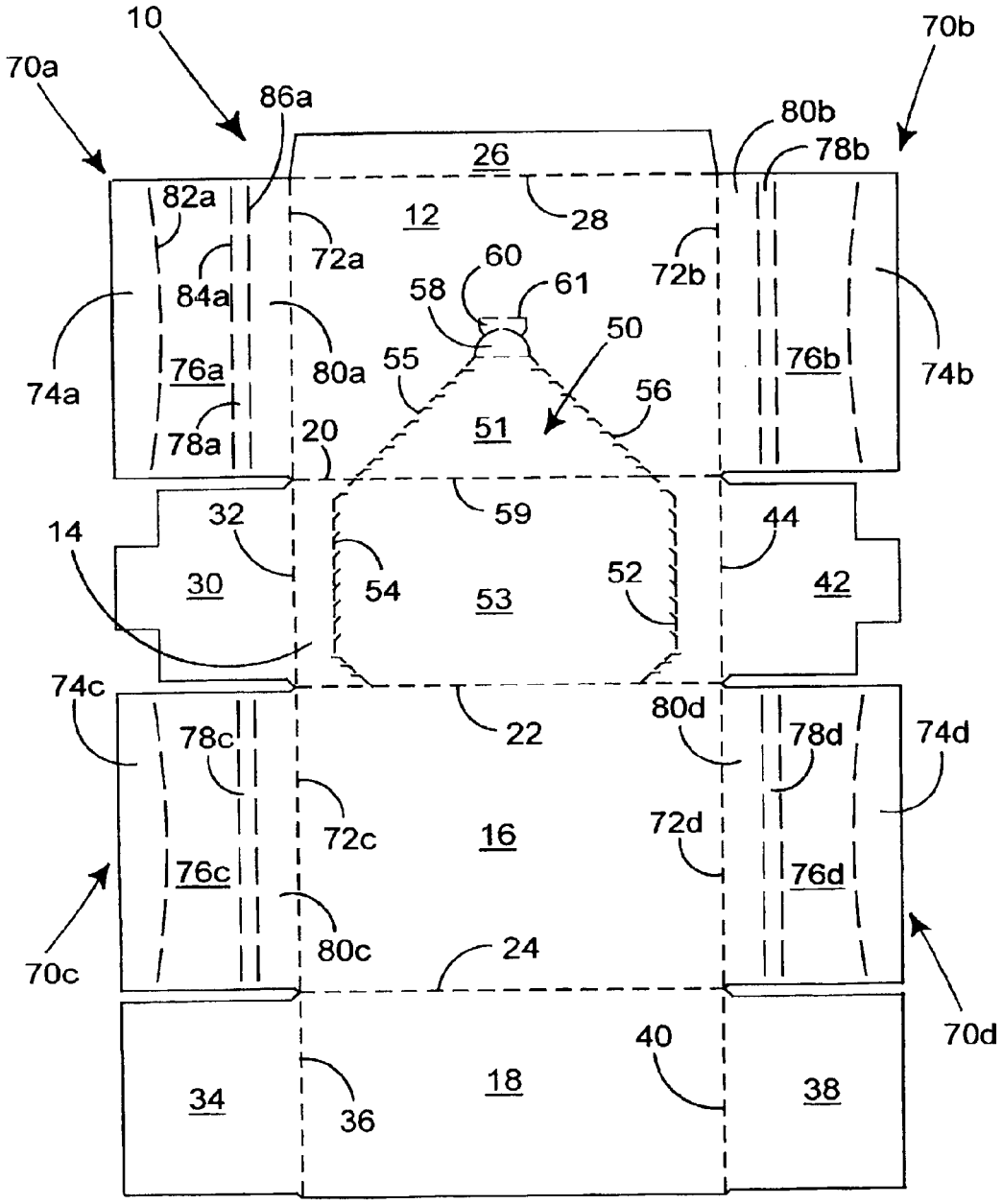
FIG. 1 illustrates the blank for forming the carton according to a first embodiment of the invention.

Referring to the drawings and in particular, FIG. 1, there is shown an embodiment of a blank for forming a carton made from paperboard or similar foldable sheet material. In the embodiment described below, the carton is a "fully-enclosed" type, although it will be recognised that the invention could be applied to a "wraparound" type carton or "basket-type" carton or other carton where it is required to provide a support structure at the corners of the carton.

The blank 10 comprises a plurality of panels for forming an enclosed carton. Turning to the embodiment shown in FIG. 1, there comprises first side wall panel 12, a top panel 14, a second side wall panel 16 and bottom panel 18 hingedly connected one to the next along fold lines 20, 22 and 24 respectively.

The ends of the carton are constructed by one or more end flaps or panels. In this embodiment, end panels 30 and 42 are hingedly connected to the opposing ends of top wall panel 14 along fold lines 32 and 44 respectively. A second pair of end panels 34, 38 is provided along opposing end edges of bottom panel 18 and hingedly connected thereto along fold lines 36 and 40 respectively.

Securing means are provided for securing together the first side wall panel 12 and bottom panel 18. In this embodiment, securing means are provided by a securing flap 26 hingedly connected to first side wall panel 12 along fold line 28.

There may further comprise an access structure to provide access to the interior of the carton. The access structure comprises a reclosable tear open flap 50 formed from one of the carton wall panels. In this embodiment the flap comprises an upper access panel 53 struck from the top panel 14 and frangibly connected thereto along frangible lines 52 and 54 respectively. Upper access panel 53 is hingedly connected to the second side wall panel along fold line 22. Preferably, there further comprises a side access panel 51 from the first side wall panel 12 and frangibly connected thereto along frangible fold lines 55 and 56 respectively. It will be seen from FIG. 1 that frangible lines 55 and 56 converge to a pull tab 58. Optionally, there further comprises a securing tab 60 hingedly connected to the first side wall panel along fold line 61. The opening of the access structure 50 will be described in more detail below.

According to one aspect of the invention there comprise one or more beam structures formed internally of the carton. The beam structures are positioned intermediate the top and bottom panels of the carton to improve the rigidity of the carton when it is subjected to vertical compression. In this embodiment there are four corner posts 70*a*, 70*b*, 70*c* and 70*d*. Each corner post is substantially the same and therefore only the first beam structure 70*a* is described in any further detail.

In the embodiment shown in FIG. 1, the corner post 70*a* comprises securing panel 74*a* and bracing panel 76*a* and an inner end panel 80*a* hingedly connected one to the next along fold lines 82*a*, 84*a*. The corner post 70*a* is hingedly connected to the first side wall panel along fold line 72*a*. In one class of embodiments, the fold line 82*a* is a shallow arcuate shape to assist in flexing the panels in the vertical plane, although in other embodiments it is linear or can be dispensed with. There may further comprise a flexing panel 78*a* intermediate bracing panel 76*a* and inner end panel 80*a* along fold lines 84*a* and 86*a* respectively. In use, fold line 86*a* is used to place the corner post in a flat collapsed condition.

It is envisaged that the panels for forming the corner post are not limited to the shape illustrated in FIG. 1 and indeed could be replaced by other means to allow a beam to juxtapose the top and bottom panels. For example, bracing panel 76 could be arcuate in cross-section to better receive and retain the adjacent article.

Turning to the construction of the carton from the carton blank as illustrated in FIG. 1, each blank requires a series of sequential folding and gluing operations which are preferably performed in a straight line machine, so that the carton and blank are not required to be rotated or inverted to complete its construction. The folding process is not limited to that described below and can be altered according to particular manufacturing requirements.

Figure 2:
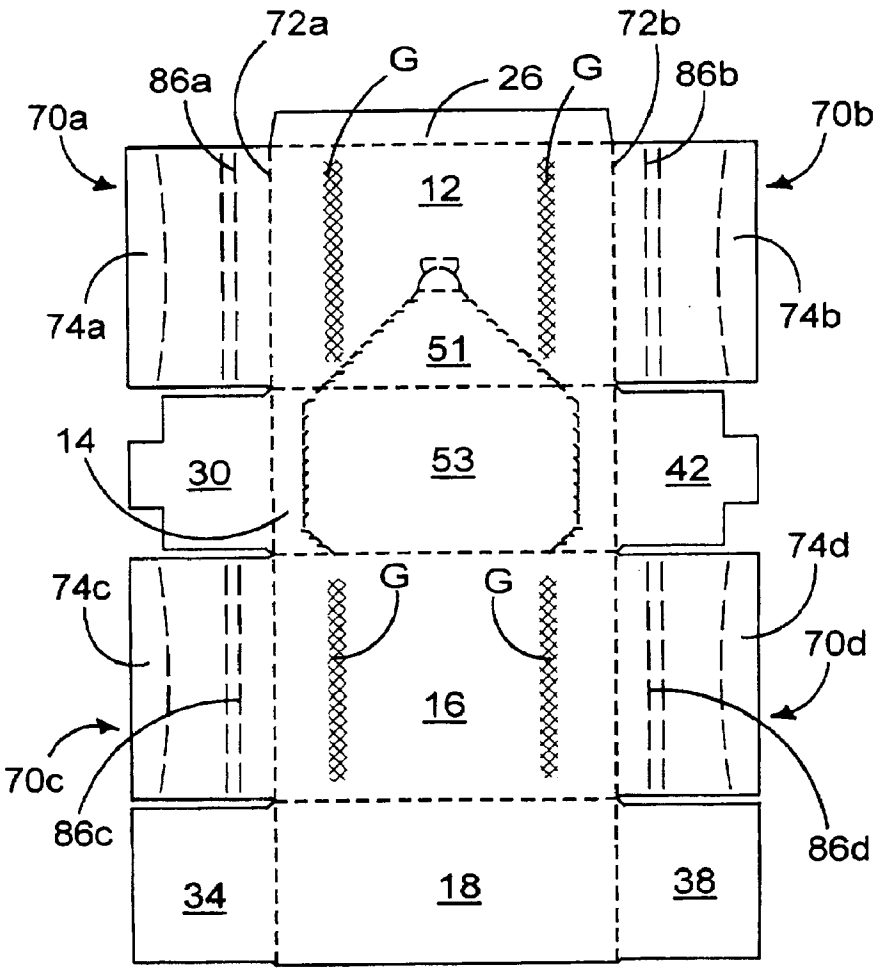
FIGS. 2 and 3 illustrate the construction of the corner support structure from the blank shown in FIG. 1.
Figure 3:
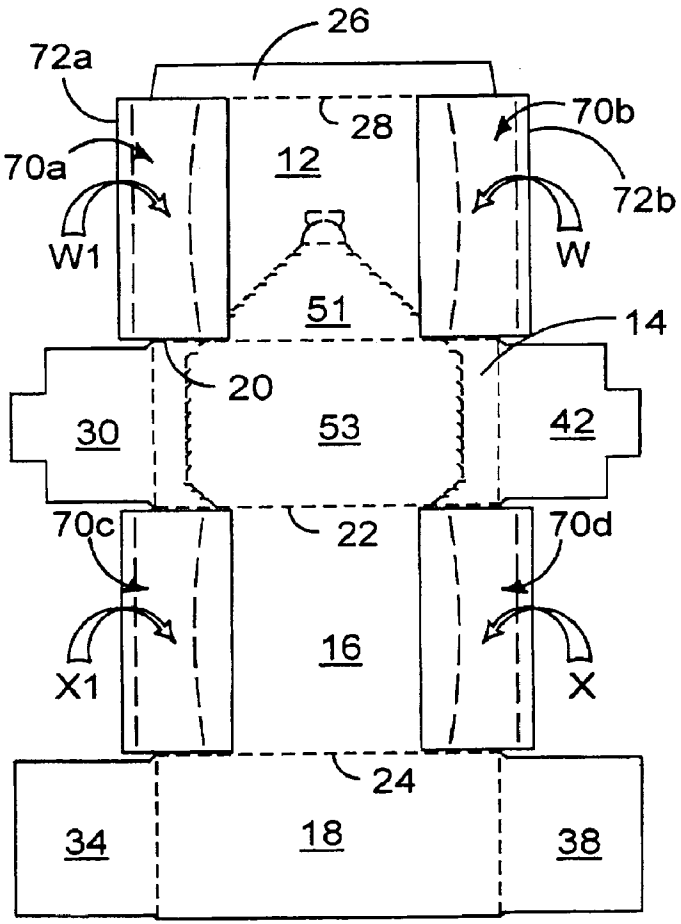
Figure 5:
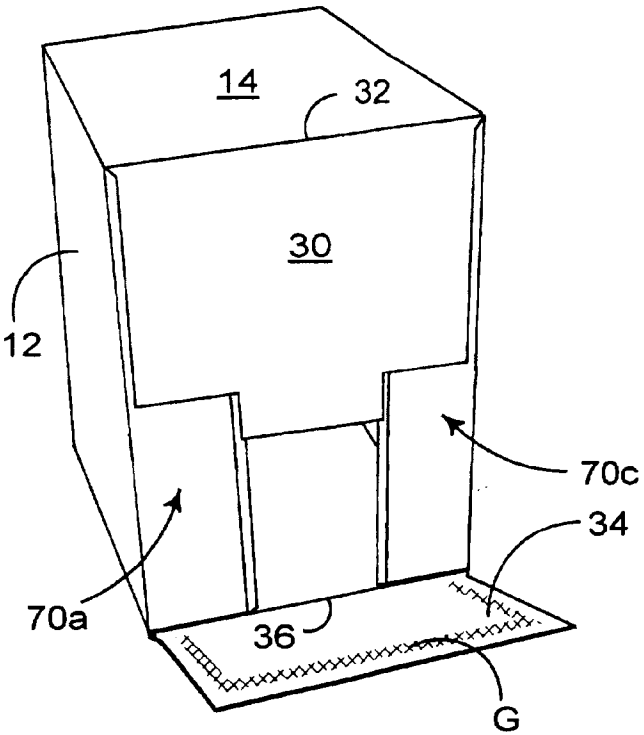
FIGS. 4 and 5 illustrate the construction of the carton from the blank shown in FIG. 1.

Turning to the construction of the corner structures from the blank 10, reference is made to FIGS. 2 and 3. The panels for forming each corner post structure 70*a*, 70*b*, 70*c*, 70*d* are folded inwardly in directions W1, W, X1 and X along fold lines 86*a*, 86*b*, 86*c*, 86*d* to be secured to the respective one of the first or second side wall panels 12, 16. In this embodiment, securing panel 74 is glued to the respective adjacent side wall panel by a strip of glue G (FIG. 2).

Thereafter, the first side wall panel 12 and bottom wall panel 18 are secured together, whereby, in this embodiment, securing flap 26 is secured to bottom panel 18 by glue or other suitable means known in the art. Thus, the carton is in a flat collapsed position ready to be supplied to an end user for loading with articles.

Figure 4:
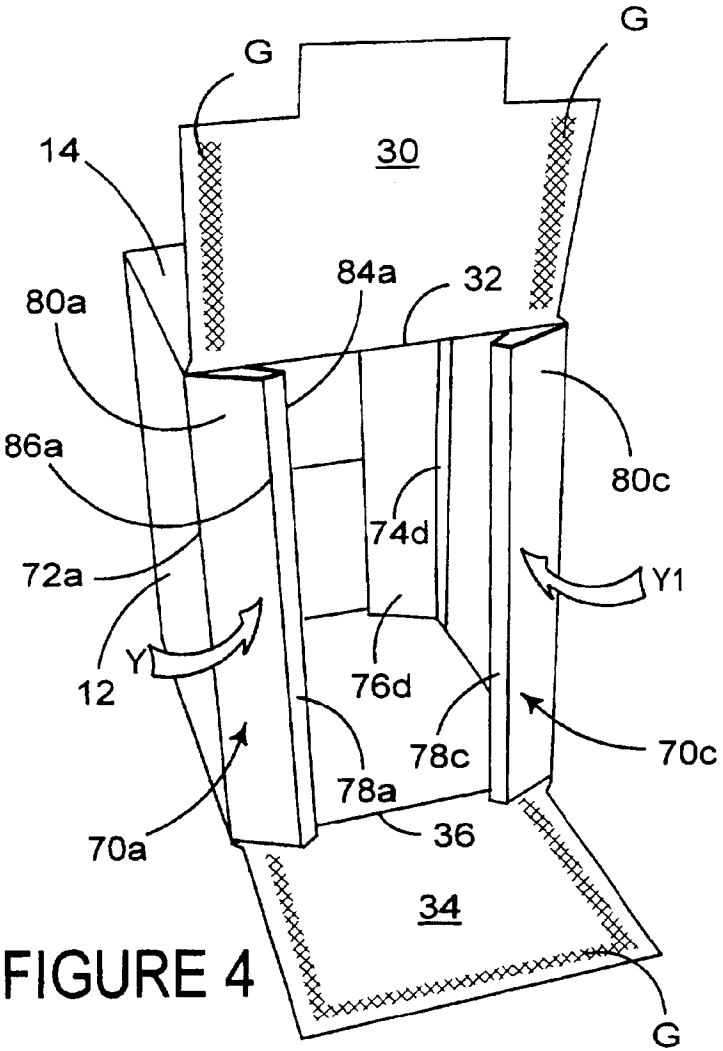

In order to erect the carton it is constructed by folding top panel 14, first side wall panel 12, bottom panel 18 and second side wall panel 16 out of alignment with each other along fold lines 28, 20, 22 and 24 respectively so as to form a tubular structure as shown in FIG. 4.

The carton is at an intermediate stage of construction whereby the articles are inserted into the carton C from one of the ends. It will be seen from FIG. 4, that end panels 30 and 34 are preferably folded outwardly along fold lines 32 and 36 respectively to guide the articles into the carton. Preferably, the opposing end wall is formed prior to receiving the articles, whereby corner post structures 70*b* and 70*d* are formed in the manner described below and end wall panels 38 and 42 are folded inwardly along the respective fold lines 40 and 44, to be secured together by glue or other suitable means known in the art.

Once the articles have been loaded into the carton, the corner post structures 70*a* and 70*c* are then formed.

Figure 9:
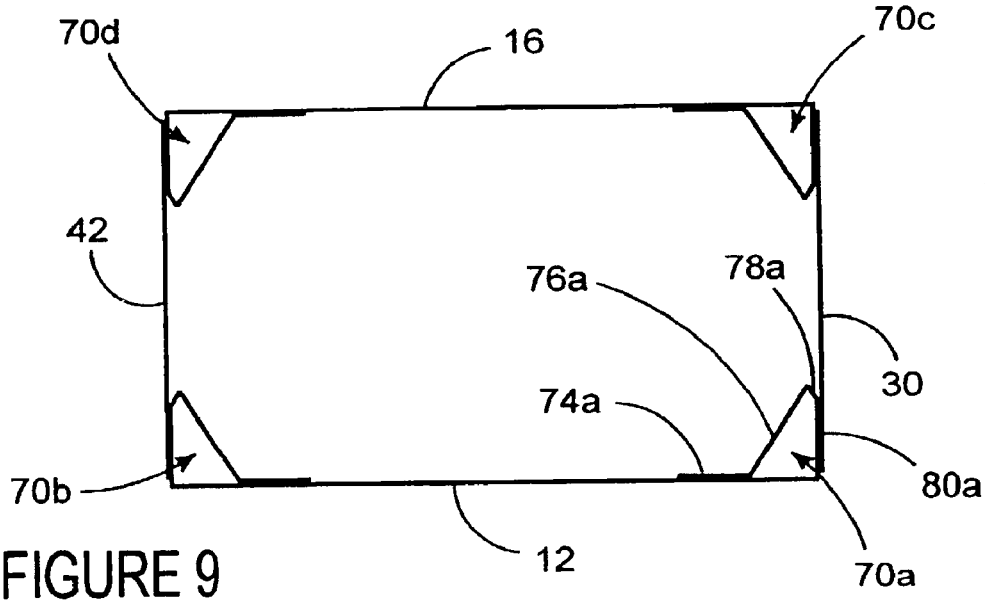
FIG. 9 illustrates a cross-section through B1–B2 of the carton in FIG. 6.

In order to form the corner post structure 70*a,* inner end panel 80*a* is folded inwardly in direction Y along fold line 72*a.* This action causes bracing panel 76*a* and intermediate panels 78*a* to be folded out of alignment with respect to securing panel 74*a* along fold lines 82*a,* 84*a* and 86*a* respectively to automatically deploy the corner post within the carton. In this embodiment the corner post has a substantially triangular cross-section viewed in more detail in FIG. 9. In one class of embodiments, the purpose of intermediate panel 78*a* is to provide a degree of resilience for the bracing panel 76*a* where for example it comes into abutment with the outermost article. However, in this embodiment, it is adapted to be placed in a co-linear arrangement with inner end panel 80*a.*

The opposing corner post structure 70*c* and the other structures 70*b,* 70*d* are formed in substantially the same manner as beam structure 70*a* and they are therefore not described in any greater detail hereinafter. Thus the carton is at the stage illustrated in FIG. 4.

In order to complete construction of the carton C, the end wall panels are secured together. To this end, glue G is applied to the inner faces of end wall panels 30 and 34 and then folded inwardly along fold lines 32 and 36 respectively and into abutment to be secured together. Preferably, the end wall panels 30 and 34 are also secured to the inner end panels 80*a* and 80*c* of their respective corner post structures 70*a* and 70*c* to provide additional securing points.

Figure 6:
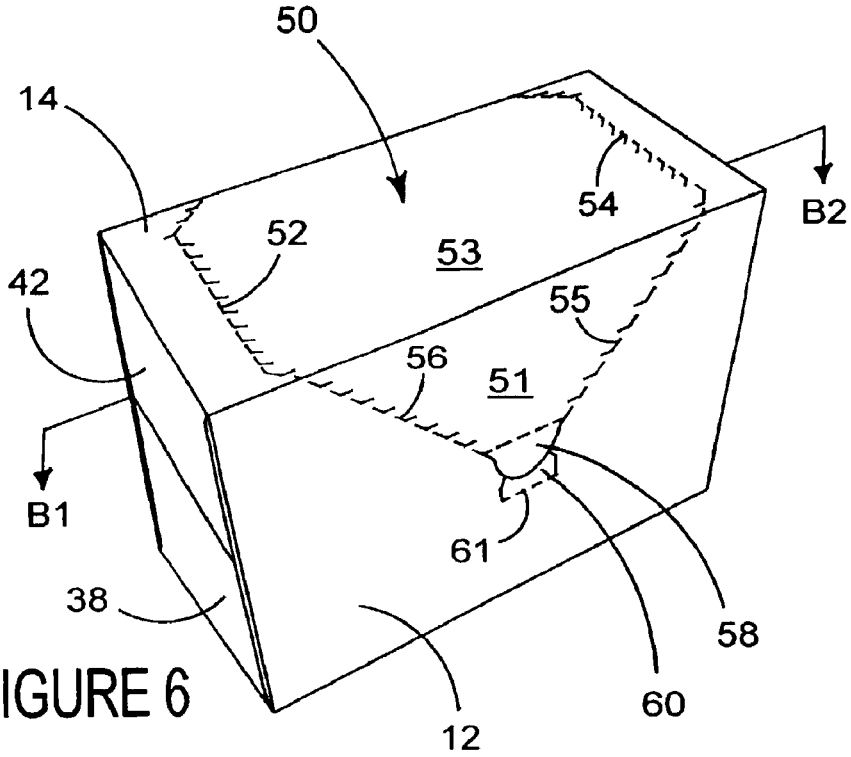
FIG. 6 shows the carton from the blank shown in FIG. 1 in an erected condition.

In alternative embodiments glue may be applied to different areas of the blank such as where corner support structure are used. Thus the carton is in a set up condition and fully loaded with articles ready to be supplied to the user, as shown in FIG. 6.

Figure 7:
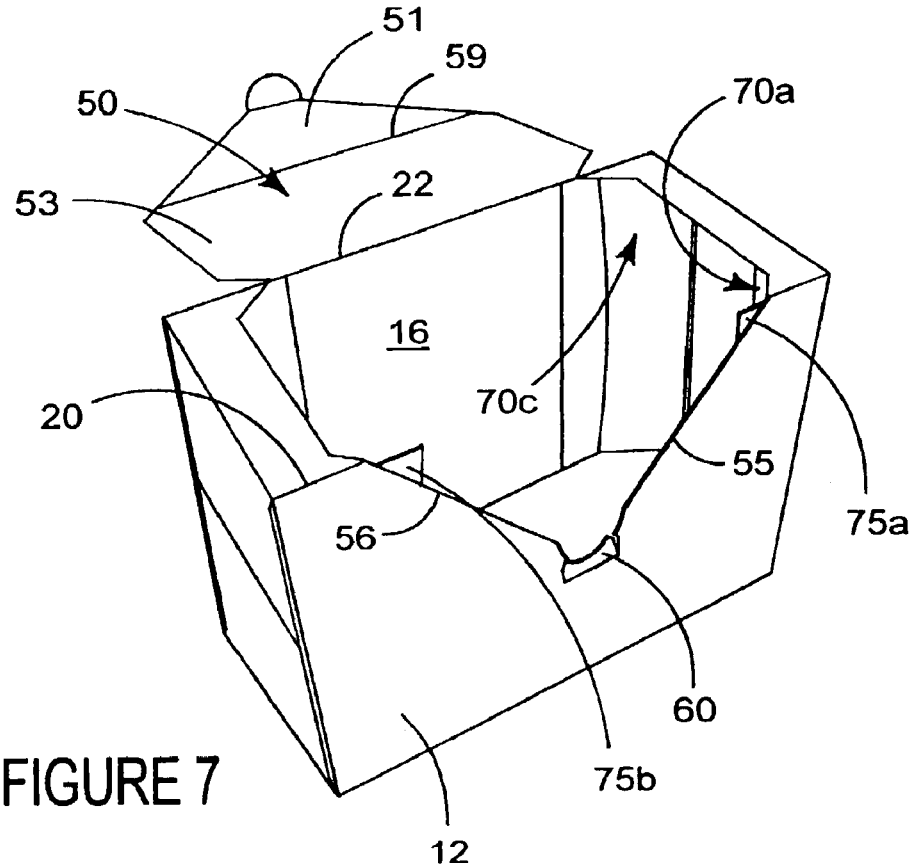
FIGS. 7 and 8 show the carton of FIG. 7 with the reclosable tear open flap in open and closed positions.

In order to gain access to the interior of the carton, the access structure can be opened whereby securing tab 60 is pushed inwardly to reveal the pull tab 58. Thereafter, the pull tab 58 is pulled in an outward direction which causes the side access panel 51 to be separated from the first side wall panel 12 along frangible lines 55 and 56. By continued pulling on pull tab 58 in an upward direction, the upper access panel 53 is separated from top wall panel 14 along fold lines 52 and 54 respectively. The access structure is folded backwards along fold line 22 to reveal the contents of the carton, as shown in FIG. 7.

Figure 8:
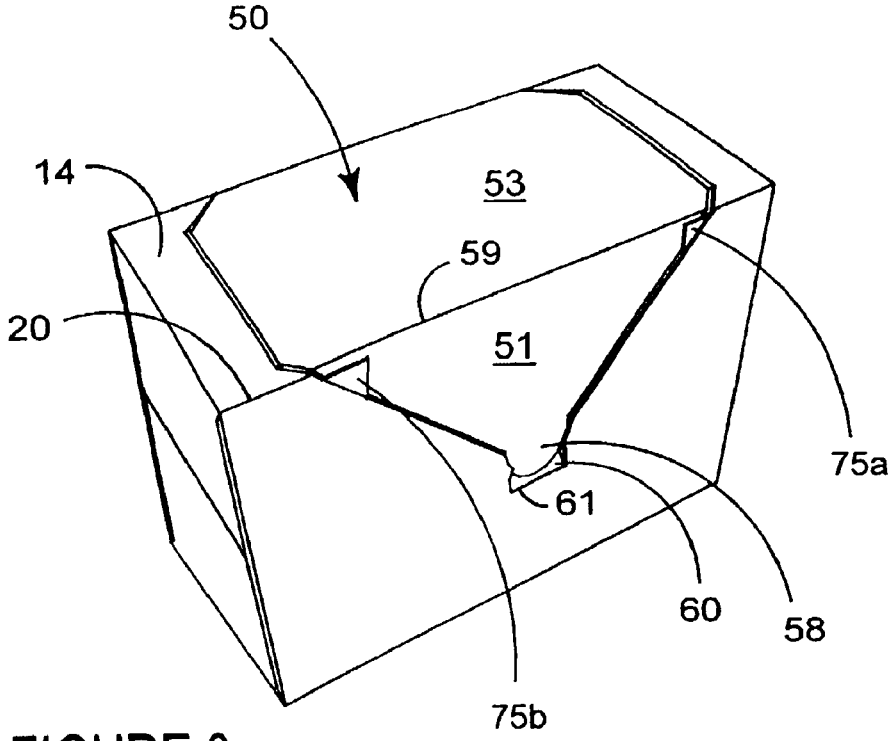

To reclose the access structure, there are provided opposing tabs 75*a* and 75*b,* which are secured to the inner face of one of the top or side wall panels. In this embodiment, tabs 75*a* and 75*b* are provided by the securing panels 74*a* and 74*b.* It is envisaged, however, that these tabs could be applied independently of the beam structure and, in fact, could be applied to cartons where no beam structures are provided. The tabs 75*a* and 75*b* are adapted so that the side access panel 51 can be placed within the carton such that the outer face of access panel 51 abuts the inner surface of insert 75*a* and 75*b* shown in FIG. 8. In order to engage the side access panel 51, pull tab 58 or—as the case may be—part of access panel 51, is placed securing tab 60 and side wall panel 12, thereby providing a pincer arrangement to secure the pull tab 58 (or access panel 51) thereto and to provide a reclosable access structure shown in FIG. 8.

Figure 10:
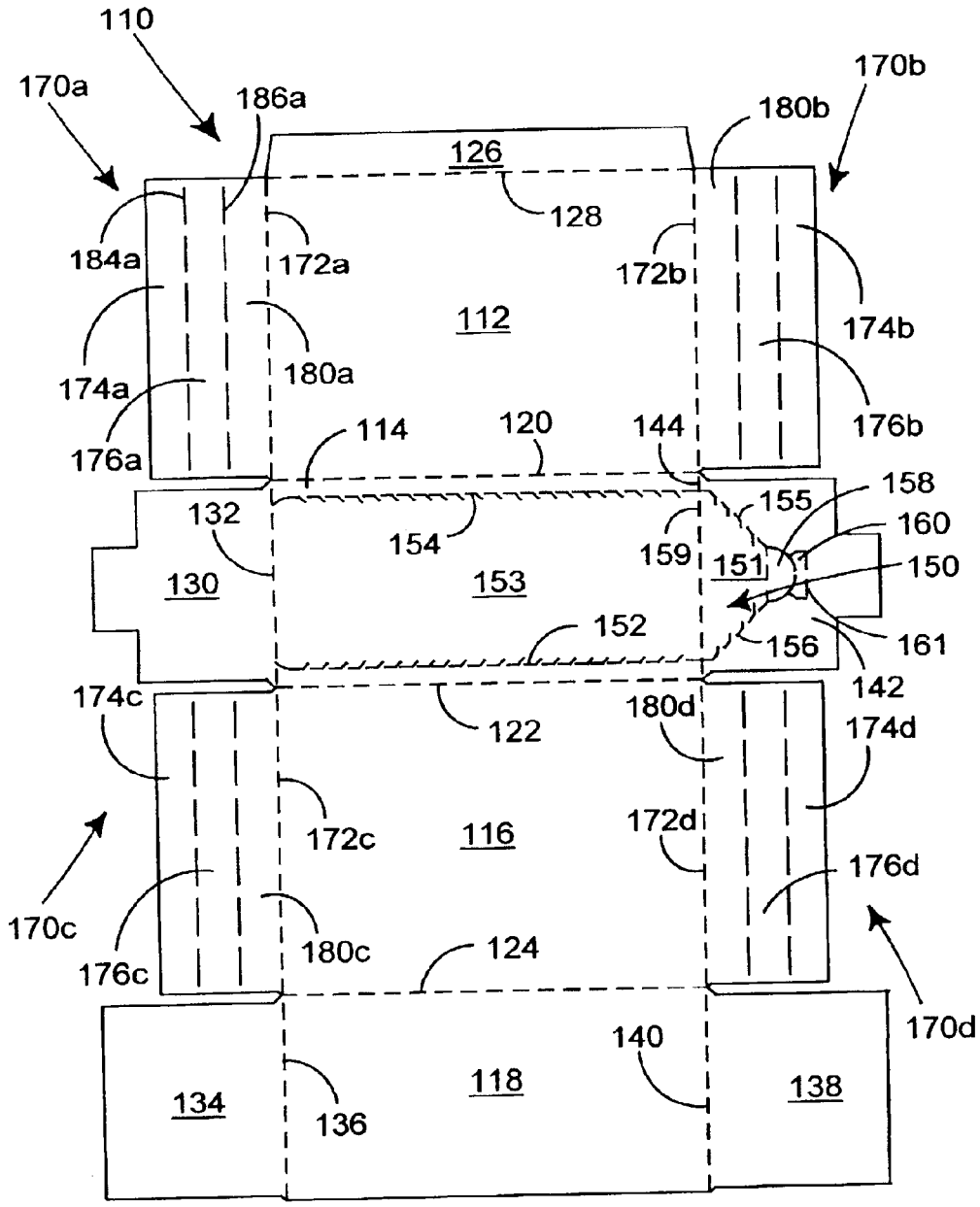
FIG. 10 illustrates the blank for forming a carton according to a second embodiment of the invention.
Figure 11:
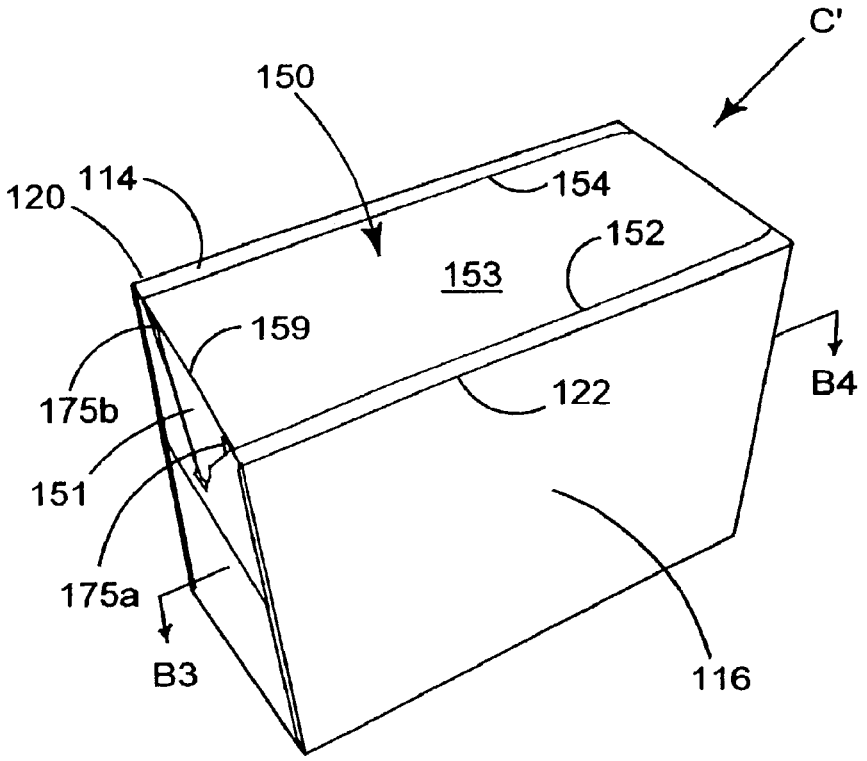
FIG. 11 shows the carton formed from the blank of FIG. 10 in an erected condition with the reclosable tear open flap in closed position.
Figure 12:
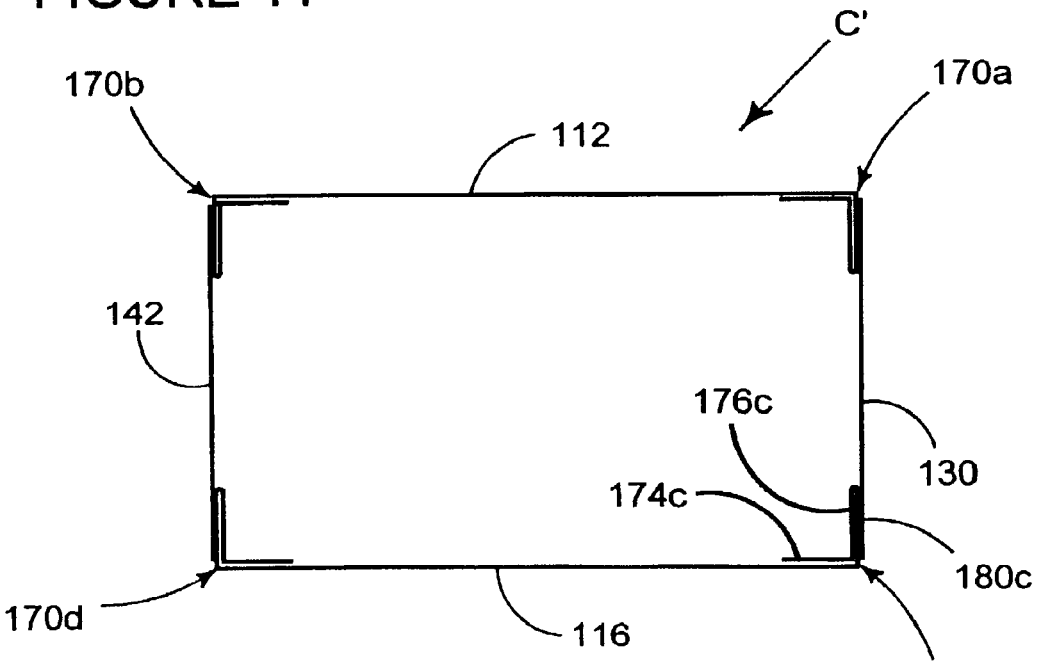
FIG. 12 illustrates a cross-section through B3–B4 of the carton in FIG. 11.

Turning to a second embodiment of the present invention in FIGS. 10 to 12, there is shown a blank 110 comprising a plurality of panels for forming an enclosed carton. With reference to the embodiment shown in FIG. 10, the blank comprises first side wall panel 112, a top panel 114, a second side wall panel 116 and bottom panel 118 hingedly connected one to the next along fold lines 120, 122 and 124 respectively.

The ends of the carton are constructed by one or more end flaps or panels. In this embodiment, end panels 130 and 142 are hingedly connected to the opposing ends of top wall panel 114 along fold lines 132 and 144 respectively. A second pair of end panels 134, 138 is provided along opposing end edges of bottom panel 118 and hingedly connected thereto along fold lines 136 and 140 respectively.

Securing means are provided for securing together the first side wall panel 112 and bottom panel 118. In this embodiment it is provided by a securing flap 126 hingedly connected to first side wall panel 112 along fold line 128.

There further comprises an access structure that provides access to the interior of the carton. The access structure is similar to the first embodiment and comprises a reclosable tear open flap 150 formed from one of the carton wall panels. In this embodiment the flap comprises an upper access panel 153 struck from top panel 114 and frangibly connected thereto along frangible lines 152 and 154 respectively. Upper access panel 153 is hingedly connected to end wall panel 130 along fold line 132.

Preferably, there further comprises a side access panel 151 struck from the first end wall panel 142 and frangibly connected thereto along frangible fold lines 155 and 156 respectively. It will be seen from FIG. 10 that frangible lines 155 and 156 converge to a pull tab 158. Optionally, there further comprises a securing tab 160 hingedly connected to the end wall panel 142 along fold line 161. The opening of the access structure 150 will be described in more detail below.

There further comprises one or more corner support structures formed internally of the carton. In the first embodiment, the support structures are positioned intermediate the top and bottom panels of the carton to improve the rigidity of the carton at the weaker parts, for example the corners of the carton.

In the second embodiment there are four corner support structures 170*a,* 170*b,* 170*c* and 170*d.* Each corner support is substantially the same and therefore only the first corner support structure 170*a* is described in any further detail. In the embodiment shown in FIG. 10, the corner support 170*a* comprises securing panel 174*a* and inner support panel 176*a* and an outer support panel 180*a* hingedly connected one to the next along fold lines 184*a,* 186*a.* The corner support 170*a* is hingedly connected to first side wall panel 112 along fold line 172*a.*

It is envisaged that the panels for forming the corner structure are not limited to the shape illustrated in FIG. 10, and could indeed be replaced by other means to allow the structure to juxtapose the top and bottom panels.

Turning to the construction of the carton from the carton blank as illustrated in FIG. 10, again each blank requires a series of sequential folding and gluing operations which are preferably performed in a straight line machine, so that the carton and/or blank are not required to be rotated or inverted to complete its construction. The folding process is not limited to that described below and can be altered according to particular manufacturing requirements.

The panels for forming each corner support structure 170*a,* 170*b,* 170*c,* 170*d* are first folded inwardly along fold line 186*a,* 186*b,* 186*c,* 186*d* to be secured to the respective one of the first or second side wall panels 112, 116. In this embodiment, securing panel 174 is glued to the respective adjacent side wall panel.

Thereafter, the first side wall panel 112 and bottom wall panel 118 are secured together whereby, in this embodiment, securing flap 126 is secured to bottom panel 118 by glue or other suitable means known in the art. Thus, the carton is in a flat collapsed position ready to be supplied to an end user for loading with articles.

In order to erect the carton it is constructed by folding top panel 114, first side wall panel 112, bottom panel 118 and second side wall panel 116 out of alignment with each other along fold lines 128, 120, 122 and 124 respectively, so as to form a tubular structure.

The carton is at an intermediate stage of construction whereby the articles are inserted into the carton C' from one of the ends. End panels 138 and 142 are preferably folded outwardly along fold lines 140 and 144 respectively to guide the articles into the carton C'. More preferably, the opposing end wall is formed prior to receiving the articles, whereby end wall panels 130 and 134 are folded inwardly along fold lines 132 and 136 respectively to be secured together by glue or other suitable means known in the art.

In order to complete construction of the carton C', the end wall panels are secured together. To this end, glue is applied to the inner faces of end wall panels 138 and 142, and then folded inwardly along fold lines 132 and 136 respectively and into abutment to be secured together. Preferably, the end wall panels 130 and 134 are also secured to part of the outer support panels 180*a* and 180*c* of the corner support structures 170*a* and 170*c* respectively to provide additional securing points.

In further embodiments, glue may be applied to different areas of the blank such as where corner support structures are used. Thus the carton is in a set up condition and fully loaded with articles ready to be supplied to the user, as shown in FIGS. 11 and 12.

It will be seen from FIG. 12 that the support structures 170*a,* 170*b,* 170*c,* 170*d* are located in the corners of the outer carton to provide additional support for the weaker parts of the carton.

In order to gain access to the interior of the carton, the access structure can be opened whereby securing tab 160 is pushed inwardly to reveal the pull tab 158. Thereafter, the pull tab 158 is pulled in an outward direction which causes the side access panel 151 to be separated from the first side wall panel 112 along frangible lines 155 and 156. By continuing to pull on pull tab 158 in an upward direction the upper access panel 153 is separated from top wall panel 114 along fold lines 152 and 154 respectively. The access structure is folded backwards along fold line 122 to reveal the contents of the carton.

In order to reclose the access structure, there are provided opposing tabs 175*a* and 175*b* that are secured to the inner face of one of the top or side wall panels. In this embodiment, tabs 175*a* and 175*b* are provided by the support panels 176*d,* 180*d;* and 176*b,* 180*b.* It will be seen from FIG. 11 that the corner structure 170*a* provides a tab to assist with the re-engagement of the end closure flap. Indeed, it is envisaged that the corner support structure could be replaced by a panel hingedly connected to side wall 112 to provide such a tab. It is envisaged that these tabs could be applied independently of the corner structure and, in fact, could be applied to cartons where no corner structures are provided.

The tabs 175*a* and 175*b* are adapted so that the side access panel 151 can be placed within the carton such that the outer face of access panel 151 abuts the inner surface of tab 175*a* and 175*b,* shown in FIG. 11. In order to engage the side access panel 151, pull tab 158 or—as the case may be—part of access panel 151, may be placed securing tab 160 and side wall panel 112 thereby providing a pincer arrangement to secure the pull tab 158 (or access panel 151) thereto and to provide a reclosable access structure.

The present invention and its preferred embodiments relate to an arrangement for providing a corner post structure in a fully enclosed carton, and for providing a tear-open flap. However, it is anticipated that the invention can be applied to a variety of carriers and is not limited to those of the fully enclosed type hereinbefore described and could be used for numerous applications where it is desired to provide a carrier with improved rigidity.

It will be recognised that as used herein, directional references such as "top", "bottom", "end", "side", "inner" and "outer" do not limit the respective panels to such orientation, but merely serve to distinguish these panels from one another. Any reference to hinged connection should not be construed as necessarily referring to a single fold line only: indeed it is envisaged that hinged connection can be formed from one or more of one of the following: a score line, a frangible line or a fold line; without departing from the scope of invention.

It should be understood that various changes may be made within the scope of the present invention; for example, the size and shape of the panels and apertures may be adjusted to accommodate articles of differing size or shape, or alternative top and bottom closure structures may be used, without departing from the scope of the invention. A single glue aperture may be provided in some embodiments. The carton may accommodate more than one article in different arrays.

What is claimed is:

1. A carton for holding a plurality of articles, comprising a collapsible tubular corner post having an essentially triangular cross-section, said corner post being formed from a series of hingedly interconnected panels including an end panel, a bracing panel and a securing panel, said end panel being hingedly connected to a side wall of the carton along a first fold line, said securing panel being secured to an inside surface of said side wall, wherein said end panel comprises a supplementary fold line disposed parallel to said first fold line to allow said corner post to be folded flat into a collapsed condition where said corner post extends outwardly of the carton, said first and supplementary fold lines extend along a tubular axis of said corner structure, said bracing panel is hingedly connected to said end panel along a second fold line parallel to said supplementary fold line, said securing panel is hingedly connected to said bracing panel along a third fold line, and said third fold line is curved convexly toward said second fold line to assist in flexing said bracing panel.

2. A carton as claimed in claim 1 wherein said end panel is secured in part to an end flap of the carton to close the carton.

3. A carton as claimed in claim 1 wherein the distance between said first and supplementary fold lines is greater than the distance between said supplementary and second fold lines.

4. A carton as claimed in claim 3 wherein the distance between said first and second fold lines is less than the distance between said second and third fold lines.

5. A blank for forming a carton for holding a plurality of articles, said blank comprising a side wall and a series of hingedly interconnected panels for forming a triangular tubular corner post upon erection of a carton, said interconnected panel including an end panel, a bracing panel and a securing panel, said end panel being hingedly connected to said side wall along a first fold line, said securing panel being adapted to be secured to said side wall upon erection of a carton, wherein said end panel comprises a supplementary fold line disposed parallel to said first fold line to allow said corner post to be folded flat into a collapsed condition, said bracing panel is hingedly connected to said end panel along a second fold line parallel to said supplementary fold line, said securing panel is hingedly connected to said bracing panel along a third fold line, and said third fold line is curved convexly toward said second fold line to assist in flexing said bracing panel upon erection of a carton.

6. A blank as claimed in claim 5 wherein the distance between said first and supplementary fold lines is greater than the distance between said supplementary and second fold lines.

7. A blank as claimed in claim 6 wherein the distance between said first and second fold lines is less than the distance between said second and third fold lines.

8. A carton for holding a plurality of articles, comprising a reclosable tear open flag defined at least in part in a first wall of the carton by a tear line, and a wall end-reinforcing member hinged to said first wall, wherein said reinforcing member is affixed at least in part to an inside surface of said first wall so that said reinforcing member underlies said first wall along at least a part of said tear line, wherein said reinforcing member is disposed astride said tear line so that a part of said reinforcing member underlies said tear open flap to provide upon breaking of the tear line an engaging element for retaining said tear open flap in a reclosed position.

9. A carton for holding a plurality of articles, comprising a reclosable tear open flap defined at least in part in a first wall of the carton by a tear line and an engaging panel affixed at least in part to an inside surface of said first wall wherein said engaging panel is disposed astride said tear line to provide upon breaking of said tear line an engaging element for retaining said tear open flap in a reclosed position, and wherein said engaging panel is provided by a corner structure disposed between said first wall and a second wall of the carton, said first and second walls being disposed adjacent to each other to define a corner of the carton therebetween, said corner structure being affixed to an inside surface of said second wall and extending to said first wall to be affixed to said first wall.

10. A carton as claimed in claim 9 wherein said corner structure comprises a first panel affixed to said first wall and a second panel affixed to said second wall, and said engaging panel is provided by said first panel.

11. A carton as claimed in claim 10 wherein said first and second panels underlie said first and second walls respectively to reinforce said corner.

12. A carton as claimed in claim 9 wherein said tear open flap comprises primary portion formed from said first wall and a secondary portion hingedly connected to said primary portion and formed from a third wall of the carton disposed adjacent to said first and second walls.

13. A carton as claimed in claim 9, wherein said first wall is provided with a retaining tab hingedly connected thereto, and a portion of said tear open flap is adapted to be placed intermediate said first wall and said retaining tab to be retained therewith.

* * * * *